US005141467A

United States Patent [19]

Crosbie

[11] Patent Number: 5,141,467

[45] Date of Patent: Aug. 25, 1992

[54] POWERED TOY UTILIZING EXPLOSIVE CAPS TO DRIVE A TOY VEHICLE FROM A LAUNCHER

[76] Inventor: Scott C. Crosbie, 4349 Brookside Ave., St. Louis Park, Minn. 55436

[21] Appl. No.: 649,675

[22] Filed: Feb. 1, 1991

[51] Int. Cl.[5] ..... A63H 5/00; A63H 29/00

[52] U.S. Cl. ..... 446/398; 446/429; 446/435

[58] Field of Search ..... 446/398, 399, 400, 429, 446/430, 435, 473

[56] References Cited

U.S. PATENT DOCUMENTS

| | | | |
|---|---|---|---|
| 332,063 | 12/1885 | Dixon . | |
| 433,427 | 7/1890 | Vogel et al. | 446/400 |
| 621,677 | 3/1899 | Hughes . | |
| 825,843 | 7/1906 | Kliemandt . | |
| 1,502,198 | 7/1924 | Hill | 446/400 |
| 1,617,480 | 2/1927 | Fourcher . | |
| 1,621,140 | 3/1927 | Thompson et al. | 446/398 X |
| 1,859,100 | 5/1932 | Lewis . | |
| 2,137,159 | 11/1938 | Fischer . | |
| 2,534,976 | 12/1950 | Kidder | 446/400 |
| 2,637,142 | 5/1953 | Kahn | 446/400 |
| 2,651,142 | 9/1953 | Buxton | 446/400 |
| 2,751,711 | 6/1956 | Greenwood | 446/399 |
| 2,803,922 | 8/1957 | Holt | 446/430 |
| 2,836,008 | 5/1958 | Nichols | 446/399 X |
| 3,000,137 | 9/1961 | Vine . | |
| 3,693,282 | 9/1972 | Adicks et al. | 446/430 |
| 3,722,124 | 3/1973 | Nathanson et al. | 446/399 X |
| 3,895,459 | 7/1975 | Morrison et al. | 446/430 |
| 4,534,745 | 8/1985 | Jones et al. | 446/398 |
| 4,536,166 | 8/1985 | Renger et al. | 446/398 X |
| 4,930,393 | 6/1990 | Castro, Jr. | 446/429 X |

FOREIGN PATENT DOCUMENTS

| | | | |
|---|---|---|---|
| 500834 | 3/1954 | Canada | 446/430 |
| 1901742 | 1/1969 | Fed. Rep. of Germany | 446/399 |
| 831824 | 9/1938 | France | 446/400 |
| 933927 | 5/1948 | France | 446/400 |
| 1083601 | 1/1955 | France | 446/399 |
| 652997 | 5/1951 | United Kingdom | 446/400 |

*Primary Examiner*—David N. Muir
*Attorney, Agent, or Firm*—Palmatier & Sjoquist

[57] ABSTRACT

A powered toy utilizing caps of the type used in toy cap guns to propel a toy vehicle. The vehicle is assembled with a launcher by a partible connector portion which has a piston portion assembled into a detonation chamber wherein the cap is detonated. The chamber is defined by an open ended housing portion which momentarily seals against the piston portion to propel the piston portion and vehicle when the cap is detonated, either by impact or electrical current.

20 Claims, 5 Drawing Sheets

POWERED TOY UTILIZING EXPLOSIVE CAPS TO DRIVE A TOY VEHICLE FROM A LAUNCHER

This invention relates to toy vehicles and particularly, to small toys of the nature that may be hand-held.

BACKGROUND OF THE INVENTION

Whereas toy vehicles have been known for a long time, and have been propelled in various ways, there have been no toy vehicles that have been capable of being propelled at high speed by artificial means.

SUMMARY OF THE INVENTION

An object of the invention is to provide a powered toy utilizing a cap of the type for use in a toy cap gun, in propelling a toy vehicle.

Another object of the invention is to provide for propulsion of a toy vehicle by cap or minute explosive charge through the use of an implement of such a size that it may be hand-held.

A feature of the invention is a separable cylinder and piston assembly defining a detonating chamber to contain a small explosive charge which is detonated, tending to drive the cylinder and piston portions in opposite directions. One of the cylinder and piston portions of the assembly is on a toy vehicle, and the other of the cylinder and piston portions are on a launcher of such a size as to be hand-held.

Another feature of the invention is the provision in such a cylinder and piston assembly of a device to cause detonation of the cap in the detonating chamber.

Still another feature of the invention is a launcher incorporating a portion of the cylinder and piston assembly and a spring operated hammer to be latched and triggered for detonating the cap.

According to the invention, the launcher is assembled with the car and when the detonating device is triggered, the detonation of the cap and the expanding combustion gases drives the cylinder and piston apart, propelling the car at high speed from the launcher.

DETAILED SPECIFICATION

Several forms of the invention are illustrated herein, as to illustrate that the invention can take many different forms.

Figure 1:
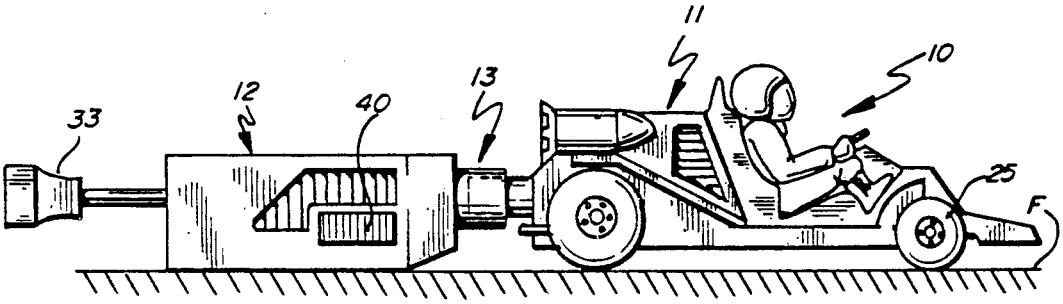
FIG. 1 is an elevation view of a preferred form of the invention.
Figure 2:
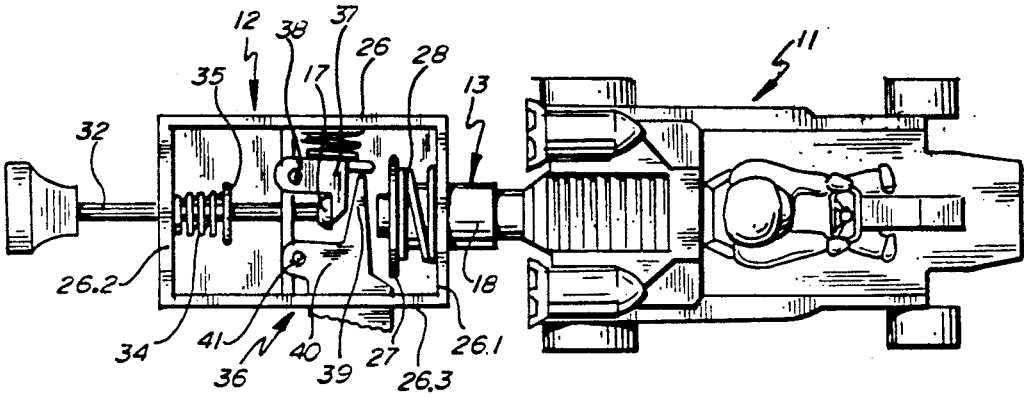
FIG. 2 is a top plan view thereof.
Figure 3:
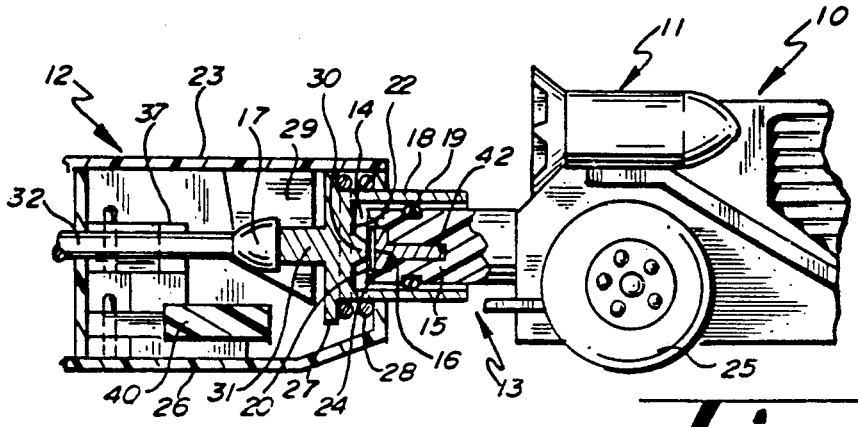
FIG. 3 is an enlarged detailed view showing the launcher portion and connection to the vehicle in section.

In FIGS. 1-3, one form of the powered toy invention is illustrated and is indicated in general by the reference numeral 10. The toy includes a small toy vehicle 11, a launcher 12, and a partible connector portion 13 between the launcher and vehicle.

An important part of the toy is an open-ended detonating chamber portion 14 as a part of the connector portion, which is to receive a piston portion or ram portion 15 which is also a part of the connector portion. The piston portion 15 is affixed to the vehicle and is assembled with the chamber portion 14 to confine a cap 16 of the type used in toy cap guns. When the cap is detonated, the sudden expansion of combustion gases in the chamber increases the pressure, causing the piston to be driven from the chamber as to rapidly propel the vehicle.

Figure 4:
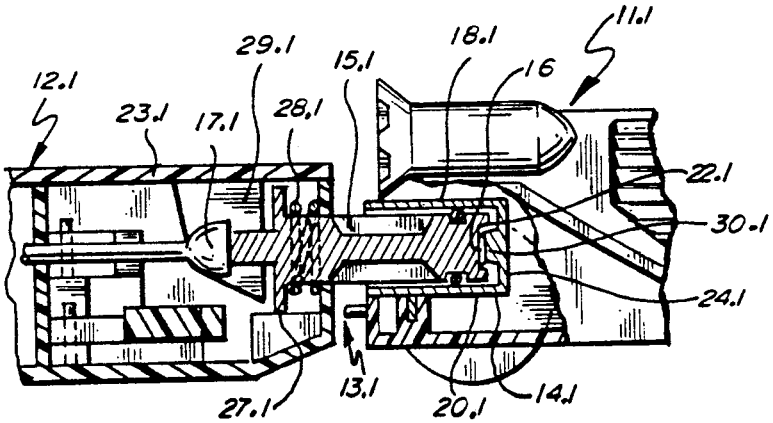
FIG. 4 is a detail view similar to FIG. 3 but showing a modified form of the connection between the launcher and vehicle.
Figure 5:
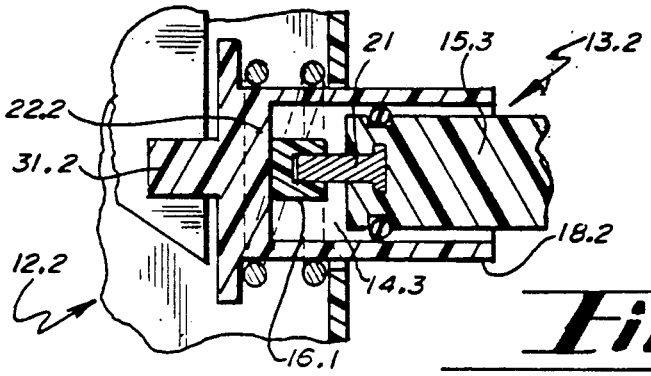
FIG. 5 is a detail section view showing a further modified form of the connection between the launcher and vehicle.
Figure 10:
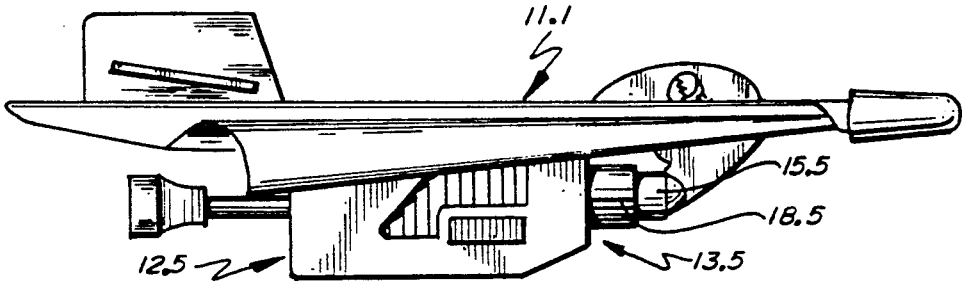
FIG. 10 is a side elevation view illustrating an alternate form of vehicle with the launcher.

As is illustrated and described herein, the powered toy 10 may take numerous forms. Alternatively, the piston portion may be on the launcher and the chamber portion may be on the vehicle. Instead of using wafer shaped caps 16, alternate cup shaped caps 16.1 as seen in FIG. 5 may be used. The piston portion or chamber portion may be fitted out to hold the cap as seen variously in FIGS. 3-7. The toy vehicle 11 may be a toy race car as illustrated in FIG. 1, but may also be a toy airplane 11.1, as illustrated in FIG. 10, or a motorcycle, or rocket ship, etc.

The launcher 12 will ordinarily be hand-held, but may also be a stationary part of a track system, or may include multiple stations for simultaneously launching a multiplicity of toy vehicles into motion. As hereinafter described, the launcher will be made ready to launch the vehicle. As illustrated in FIGS. 1-3, locking of the hammer 17 in the launcher, subjected to triggering or releasing, is one form of making the launcher ready for operation. Other forms of readying the launcher for operation may be employed.

The partible connector portion 13 may take any of several forms. Along with the chamber 14 and piston portion 15, thrust absorbing portion 24 on the end of piston portion 15, and recoil absorbing portion 22 at the inner end of chamber 14, are extremely important to the functioning of the toy. Regardless of whether the chamber is on the launcher 12 or vehicle 11, or the piston portion is on the vehicle or launcher, there must be a thrust absorbing portion on the vehicle and a recoil absorbing portion on the launcher. The chamber 14 may be on the launcher 12 and the piston portion 15 may be on the vehicle 11 as in FIGS. 1-3, but the arrangement may be reversed, as in FIG. 4, with the chamber 14.1 on the vehicle and the piston portion 15.1 on the launcher 12.1.

Figure 11:
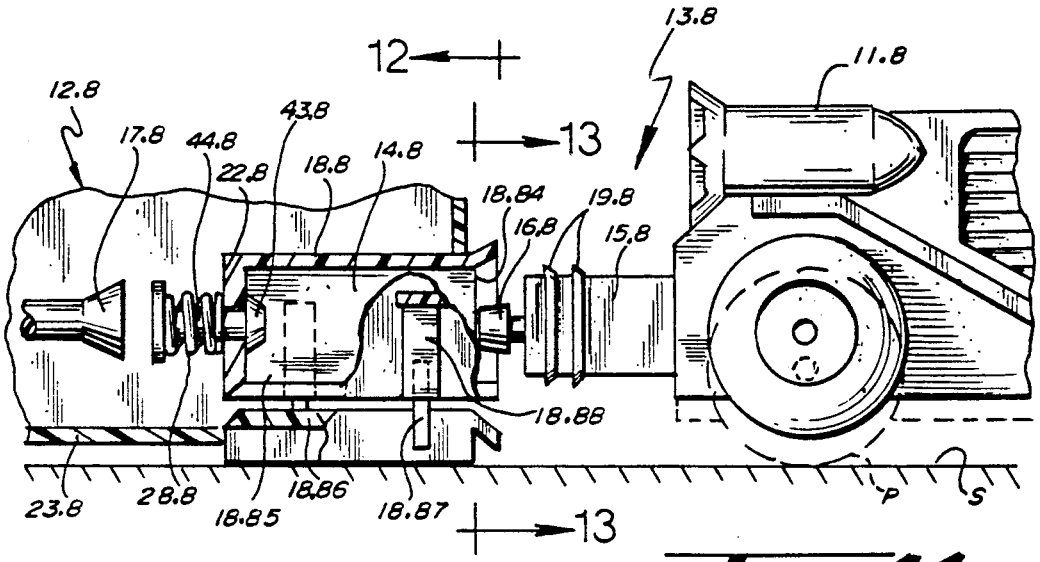
FIG. 11 is an elevation view, partly broken away and shown in section, of another preferred form of the invention.

The chamber may take any of a number of shapes, but it is important that the chamber be essentially closed at the time of detonation of the cap as to propel the piston out of the chamber and to propel the vehicle. Some escape of combustion gases may be permissible, but most of the gases will be confined at the moment of detonation of the cap. The chamber 14 of FIGS. 1-3, as illustrated, is round and cylindrical and is defined by a cylindrical housing portion or ram housing 18 which receives the piston portion 15 and the O-ring 19 on the piston portion. The O-ring seals and slides along the housing portion 18 and at least momentarily seals the chamber 14 during detonation of the cap. Portions of the chamber 14 and housing portion 18 may be, in some instances, partially flared or conical, allowing portions of the combustion gases from cap 16 to escape or "blow by" the piston portion 15 as the piston portion starts to move along the housing portion 18. Alternatively, the chamber portion may be three-sided, requiring that the chamber portion be pressed onto a fourth side, as seen in FIG. 11, or onto the floor to close around the piston portion before propulsion can result from detonating a cap.

In FIGS. 1-3 and several other forms, the chamber housing 18 or the portion of the partible connection on the launcher, is movable with respect to the launcher frame. However, as seen in FIGS. 8 and 11-13, the chamber housing may be fixed to the launcher frame, and only the hammer and cocking rod and detonating pin will move to impact the cap.

The piston portion 15 is affixed to the frame of the car 11 in FIGS. 1-3, to mate with or assemble with the cylinder 14 on the launcher 12. In other arrangements, the piston portion 15.1 may be on the launcher as in FIG. 4. Otherwise, the piston portion 15.2 may itself comprise a cylinder sleeve, as in FIG. 6, to fit within the chamber housing portion 14.2. Whatever the shape of the piston portion, its primary function is to fit into the chamber and at least momentarily respond to detonation of the cap; and if the piston portion is on the car, absorb and transmit the thrust to the car, as in FIG. 3; and if the piston portion is on the launcher, absorb the recoil from the cap detonation, as in FIG. 4.

The cap 16 of the type for use in toy cap guns, may have the shape of a small wafer, approximately one-eighth inch diameter, and having a small charge of explosive powder sealed between paper or plastic film laminae. Such a cap 16 may be carried in a recess or facing 20 on the end face of piston portion 15, and such a mounting recess may be provided on the piston portion, regardless of whether the piston portion is on the launcher or on the vehicle.

Figure 6:
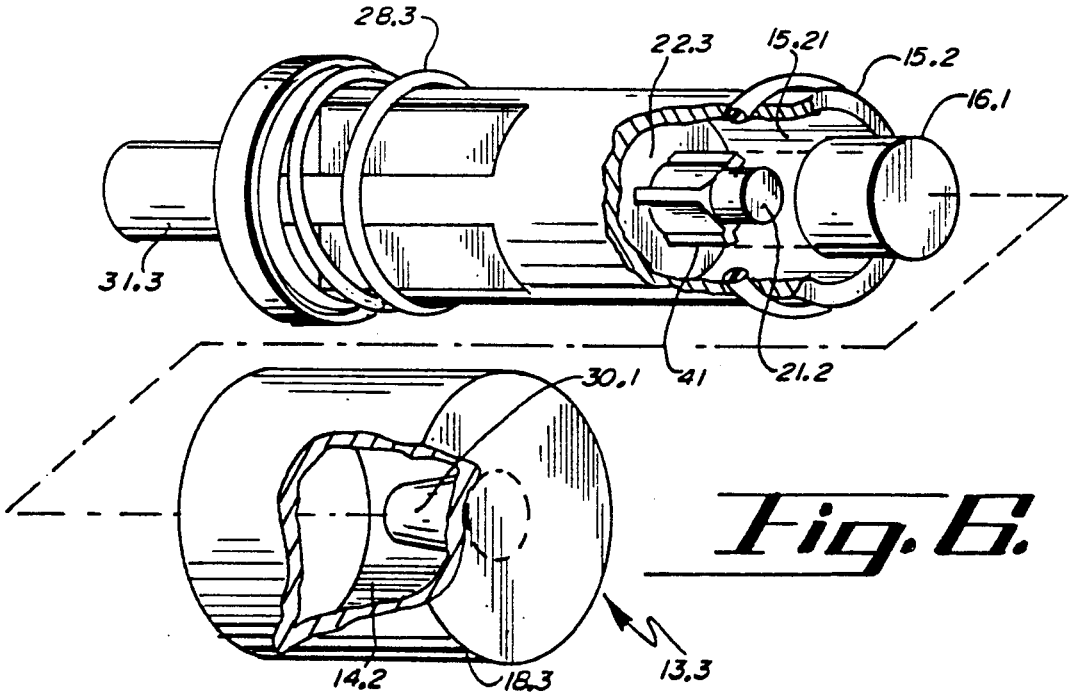
FIG. 6 is an exploded perspective view of still another modified form of the connection between the launcher and vehicle.

Alternately, other forms of caps may be used, such as the cup shaped cap 16.1 of FIGS. 5 and 6. Such a cap has a molded plastic receptacle, approximately one-eighth inch diameter, with a small powder or explosive charge in its bottom, and may be mounted on a post or peg 21 on the end of the piston portion 15.3 as in FIG. 5.

Various devices may be used for detonating the cap in the chamber of the portable connector portion 13. Typically, the cap is detonated by suddenly impacting or applying pressure onto the cap; otherwise the cap may be electrically detonated as in FIGS. 11, 12. In FIGS. 1-3, and FIG. 4, the recoil absorbing portion 22 of the chamber housing portion 18 in FIG. 3, or the recoil absorbing portion 22.1 of piston portion 15.1 in FIG. 4, is slidable with respect to the launcher frame 23 (FIG. 3), 23.1 (FIG. 4). As the spring pressed hammer 17 or 17.1 of the launcher drives the recoil absorbing portion against the cap, the cap detonates to propel the thrust absorbing portion 24, 24.1 and car from the launcher.

With specific reference to FIGS. 1-3, it is to be noted that the car or vehicle 11 has rotary support wheels 25 so that the car will travel speedily along a floor or table surface F which may also take the form of a track to guide the car in a desired direction.

The launcher frame 23 serves as its housing and has enclosing walls 26 defining the sides, ends, top and bottom of the launcher. The end wall 26.1 has an opening therein through which the cylindrical housing 18 extends; and the housing 18 is loose in the opening of end wall 26.1 so that the end wall may move slightly in an endways direction. The cylindrical housing 18 has a flange 27 protruding from its inner end, within the launcher frame, and a metal coil spring 28 is interposed between the flange 27 and the launcher end wall 26.1 so as to normally urge the housing 18 inwardly of the launcher frame and against the edge of a stop panel 29 which is rigidly affixed to the launcher frame and the edge of which confronts the rear closed end of the cylindrical housing 18. The stop panel 29 limits the extent of inward movement of the housing 18, and also absorbs recoil as the cylinder housing 18 moves under influence of the detonation of the cap, and the spring 28 permits the housing 18 to be driven outwardly of the launcher frame under influence of the hammer 17 for detonating the cap.

The recoil absorbing portion 22 of the housing 18, which also comprises the inner facing or bottom of the housing 18, also has a tapered nodule or lug 30 projecting therefrom to engage or bear against the cap 16 carried in the recess 20 of the piston 15. The lug 30 functions to retain the cap 16 on the end face or thrust engaging portion 24 of the piston 15, and when the hammer suddenly impacts the stem 31 of the housing 18, the lug 30 will suddenly apply great pressure onto the cap 16 as to cause detonation of the cap.

The detonating hammer 17 is mounted on an elongate cocking rod 32 of the launcher 12, and the rod 32 is slidable in the launcher frame. Rod 32 has a knob or handle 33 on its outer end for pulling the rod into cocked position as illustrated in FIGS. 1 and 2; and a coil spring 34, which is anchored between the rear wall 26.2 of the launcher frame and a transverse pin 35 affixed on the rod 32, will drive the rod and hammer forwardly against the stem 31 and housing 18 when the rod is released.

A latching mechanism, indicated in general by numeral 36, is provided in the launcher 12 to retain the hammer 17 and rod 32 against the pressure of spring 34. The latching mechanism includes a retainer hook or latch 37, swingably mounted on the launcher frame as by pin 38 and confronting the hammer 17 to retain the hammer in cocked position. A portion of the latch 37 extends off to the side to avoid the rod 32, and is engagable by a projection 39 on a swingable release control or trigger 40 pivotally mounted on a pin 41 on the launcher frame and projecting through the side wall 26.3 so as to be operated by a person's thumb as he holds the launcher !2 in his hand. When the control 40 is pressed inwardly by a person's thumb, the latch 37 releases the hammer 17 which will strike the stem 31 under the influence of spring 34 to impact the housing and the cap 16 to detonate the cap under the sudden pressure applied. All of the forms of the launch with the exception of FIGS. 9, 11 and 12, use a cocking rod and latch and release or trigger as in FIGS. 1–3; however, other forms of hammer latching and release or trigger may be substituted.

The piston 15 is affixed on the rear portion of the car or vehicle 11, or the piston may be formed integrally of the body of the car. In order to provide strength in the piston 15, which is normally molded of plastic integrally with the car body, a metal insert 42 may be molded into the piston 15 to absorb the shock and thrust and to cooperate with the lug 30 in detonating the cap 16.

In preparing the car to be launched, a cap is first inserted into the recess in the end face of the piston 15 and then the piston 15 is telescopically assembled into the housing 18, reducing the size of the chamber 14 until the lug 30 engages the cap 16, whereupon the bottom wall of the housing 18 and the end of piston 15 comprise facing portions confronting each other to respectively absorb the recoil and thrust produced by detonation of the cap in the chamber 14. When the hammer impacts the stem 31, the cap 16 is detonated to cause the piston 15 to be driven out of the chamber 14 by the expanding gases and to propel the car or vehicle 11 forwardly.

In the form illustrated in FIG. 4, the launcher and vehicle are substantially the same as illustrated in FIGS. 1–3, except that in the partible connection portion 13.1, the piston and the chamber housing are reversed as between the vehicle and the launcher. The housing portion 18.1 is affixed on the frame of the vehicle 11.1, and the piston 15.1 is mounted on the launcher frame 23.1 and is mounted for limited endways movement through an opening in the end wall of the launcher. The piston has an enlarged flange 27.1 thereon which anchors the spring 28.1 and also will bear against the edge of stop panel 29.1 to limit the movement of piston 15.1 inwardly of the launcher. The hammer 17.1 is identical to the hammer 17 of FIGS. 1–3; and the launcher 12.1 also has cocking, latch and releasing mechanism all like that illustrated in FIGS. 1–3. At the bottom of the cylinder 18.1, the thrust absorbing portion 24.1 has a lug or nodule 30.1 to bear against the cap 16 in the recess 20.1 of the piston 15.1. The end face of the piston 15.1 provides a recoil absorbing portion 22.1. When hammer 17.1 drives the piston portion and cap 16 against lug 30.1, the cap is detonated, causing the housing portion 18.1 to separate from the piston portion 15.1 and propel the vehicle.

In FIG. 5 a modified form of partible connection 13.2 is illustrated, for connecting the vehicle to the launcher. In this form, the piston portion 15.3 is shown assembled into the chamber 14.2 which is defined by the cylindrical open ended housing. The housing portion 18.2 comprises a portion of the launcher 12.2 which is almost identical to the launcher 12 of FIGS. 1–3, but in this version, the inner surface of the recoil absorbing bottom portion 22.2 of the housing has a flat inner surface against which the cup-shaped cap 16.1 bears. The cap 16.1 is mounted on the mounting peg or post 21 which is molded into the piston 15.3, but could be formed integrally thereof. In this form, detonation of the cap is produced by causing an impact through the stem 31.2 so that the sudden application pressure will cause a detonation of cap and driving of the piston out of the housing and propelling of the vehicle. In this form illustrated in FIG. 5, the mounting of the cap 16.1 on the peg 21 which is part of the piston 15.3 minimizes the possibility of misuse of the launcher because the cap will not be mounted in the launcher and the launcher cannot be misused for the purpose of propelling some other media from the housing 18.2.

In the form of the invention illustrated in FIG. 6, another modified form of the partible connection 13.3 is illustrated. The chamber portion 14.2 for receiving the piston portion 15.2 is defined by the cylindrical housing 18.3 which will be affixed to the vehicle of the toy. The piston portion 15.2 in this version is arranged for mounting on a launcher and is provided with the retention spring 28.3 and a stem 31.3 against which the hammer of the launcher will impact and the piston portion 15.2 is provided with an internal chamber 15.21 which will communicate with the chamber 14.2 when the piston portion assembled into the chamber 14.2. The piston portion 15.2 has a recoil absorbing portion 22.3, on which a standard 41 is affixed to carry the cap mounting peg or post 21.2. The cap 16.1 will be slipped on to the peg 21.2 and then the piston portion 15.2 is assembled into the chamber 14.2 until the lug or nodule 30.1 bears against the cap and apply localized pressure when the piston portion 15.2 is impacted by the hammer and suddenly moves against the lug 30.1.

Figure 7:
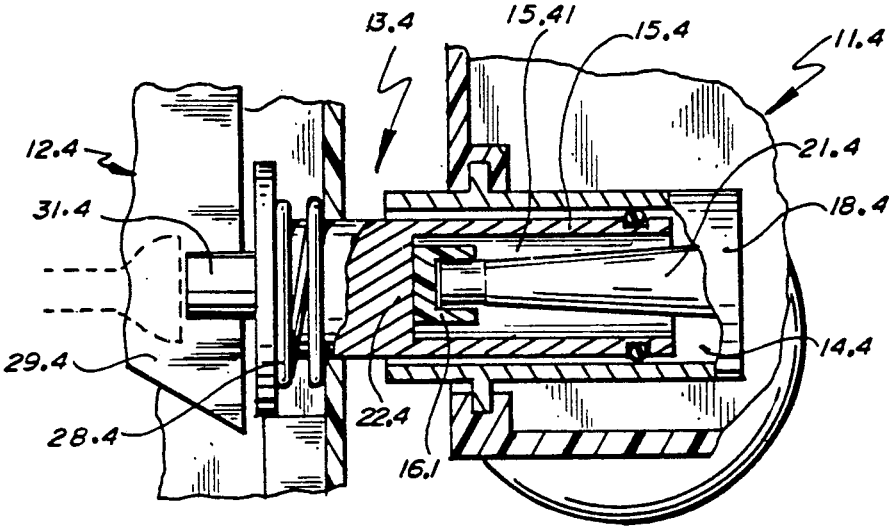
FIG. 7 is an enlarged detail section view of another modified form of the connection between the launcher and vehicle.

In the form of the invention illustrated in FIG. 7, the vehicle body 11.4 and the launcher 12.4 are arranged slightly differently, but only to accommodate a variation in the form of partible connection 13.4. The chamber portion 14.4 is defined by a cylindrical housing portion 18.4 which is affixed to portions of the vehicle body. The chamber 14.4 receives the piston portion 15.4; and an elongate peg or post 21.4 is affixed into the bottom of the housing 18.4 and extends substantially to the mouth of the housing 18.4 to mount and carry a cup shaped cap 16.1. It will be recognized that the piston portion 15.4 also defines a chamber portion 15.41 into which the cap mounting post extends and positions the cap 16.1 against the recoil absorbing portion 22.4 of the piston portion. The piston portion 15.4 is also loosely confined on the launcher 12.4 and free to move endways, and piston portion 15.4 is normally pressed by coil spring 28.4 against the stop panel 29.4 so that the piston portion 15.4 is free to move incrementally forwardly toward the vehicle to some slight extent when the hammer of the launcher impacts the stem 31.4 for moving the piston portion 15.4 against the cap and causing detonation of the cap.

Figure 8:
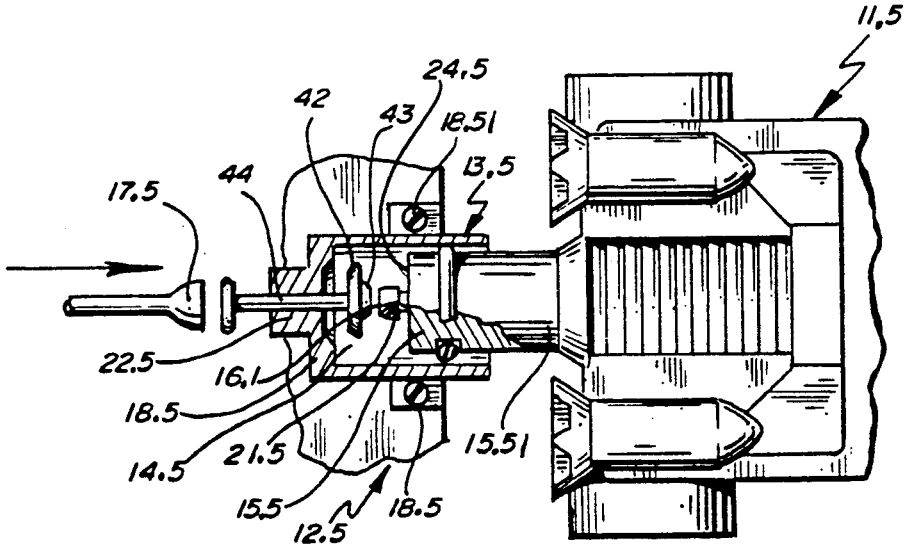
FIG. 8 is a detail section view of another form of the connection between the launcher and vehicle.

In FIG. 8, the vehicle 11.5 and the launcher 12.5 has another modified form of partible connection 13.5 therebetween. In this form, the piston portion 15.5 is wafer shaped and is affixed by a stem or post 15.51 solidly to the frame of the vehicle 11.5; and the housing portion 18.5 defining the chamber 14.5 in which the piston 15.5 is received, is solidly affixed to the launcher frame as by rivet fasteners 18.51. The thrust absorbing portion 24.5 of the piston portion has a cap mounting peg or post 21.5 affixed thereon and mounting a cup type cap 16.1 thereon. A slidable cap detonator 42 has a lug or nodule 43 thereon confronting the cap 16.1 and peg 21.5. A mounting rod 44 is slidable through the inner end or recoil absorbing portion 22.5 of the housing 18.5 for driving the detonator 42 against the cap when the hammer 17.5 is operated in a fashion similar to that of FIGS. 1–3.

This form illustrated in FIG. 8 has the obvious advantage of requiring only one simple movable part, detonator 42 with its stem or mounting rod 44, while the housing 18.5 is solidly affixed to the frame of the launcher 12.5.

A variation on the form of FIG. 8 may reverse the housing and piston portions, i.e. mounting the housing portion solidly on the vehicle, and mounting the piston portion solidly on the launcher and providing a detonator (like detonator 42) slidable on the piston portion to act under influence of the launcher hammer to detonate the cap.

Figure 9:
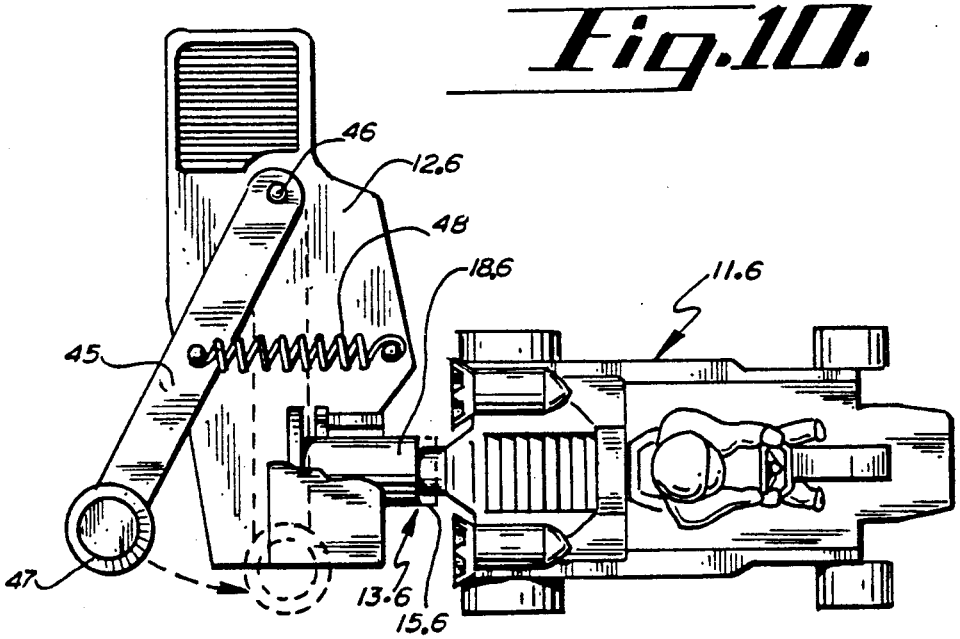
FIG. 9 is a top plan view of an alternate form of launcher and vehicle.

In the form of the invention illustrated in FIG. 9, the vehicle 11.6 is substantially identical to that illustrated in FIGS. 1-3, and the launcher 12.6 is connected to the vehicle by a partible connector portion 13.6 as substantially similar to that illustrated in FIGS. 1-3. A piston portion 15.6 on the vehicle is assembled into the chamber of housing 18.6 which will also confine a cap to be detonated for propelling the vehicle. The housing 18.6 is mounted on the frame of launcher 12.6 in a manner similar to that of FIGS. 1-3. In the launcher 12.6, a swingable arm 45 serves as a hammer for impacting the rear portion of housing 18.6 for detonating the cap and causing the piston 15.6 to be propelled out of the chamber of the housing 18.6 and also propelling the vehicle. The arm 45 is mounted on a pivot pin 46 on the launcher frame, and a handle 47 is also mounted on the arm 45 to swing the arm into the full line position thereof, against the tension of spring 48 which, when the handle 47 is manually released, will swing the arm 45 into the dotted line position illustrated, whereupon the side of the arm 45 will impact against the rear of the housing 18.6 for impacting the cap and causing detonation thereof. Here there is an absence of a trigger for releasing the hammer or arm; in some cases of other forms, as in FIGS. 1-3, the latch and trigger may be eliminated, and detonation may be obtained by simply manually releasing the cocking rod.

The form of the toy illustrated in FIG. 10 incorporates an airplane or glider 11.1 which is propelled by a launcher 12.5 which may be the same type as illustrated in connection FIGS. 1-3. A partible connection portion 13.5 may be similar to that illustrated in FIGS. 1-3 (or in other forms) and includes a piston portion 15.5 and a housing portion 18.5 defining the chamber which receives the piston therein and confines a cap for producing the thrust for launching the airplane when the cap is detonated.

Figure 12:
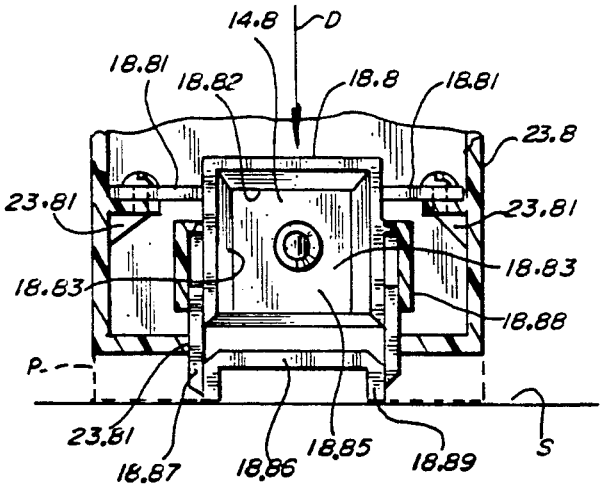
FIG. 12 is a detail section view taken at 13—13 of FIG. 12.
Figure 13:
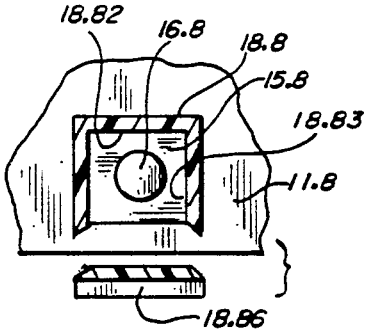
FIG. 13 is a detail section view taken at 14—14 of FIG. 12.

In the form of the invention illustrated in FIGS. 11, 12 and 13, the vehicle 11.8 is connected to the launcher 12.8 by the partible connection 13.8 which includes a piston portion 15.8 with sealing gasket rings 19.8 thereon. The chamber housing 18.8 is affixed solidly to the launcher frame 23.8 by a pair of brackets 23.81 affixed on the frame and a pair of housing mounting arms 18.8 which are affixed as by welding to the housing 18.8 and are affixed to the brackets 23.81 by machine screws as shown. In this instance, the chamber 14.8 defined by the housing 18.8 is substantially square or rectangular, as seen in FIG. 12. The housing 18.8 has a top wall 18.82 and a pair of sidewalls 18.83, and of course, the end 18.84 of the housing is open to receive the piston 15.8 therein. Of course, the piston 15.8 is similarly rectangular or square in cross section, to correspond to the shape of the chamber 14.8.

The housing 18.8 also has an open bottom side 18.85 to define an exhaust port which must be closed before detonating a cap in the chamber as to confine the detonating gases and propel the piston and vehicle. A closure panel 18.86 confronts the open bottom side of the housing 18.8 and is assemblable with the housing 18.8 so as to entirely enclose the chamber 14.8 immediately prior to detonating a cap therein. The closure panel 18.86 mounts a number of upright guide rods 18.87 which extend into the openings of upright guide ways 18.88 which are affixed on the sidewalls of the housing 18.8.

The closure panel 18.86 also has a pair of depending feet 18.89 for engaging a surface S upon which the vehicle 11.8 is to travel. It will be recognized that the launcher frame 23.8 has an enlarged opening 23.81 through which the closure panel 18.86 may move as the closure panel is urged into the open side 18.85 of the housing.

A slidable pin 44.8 extends through a bearing opening in the thrust absorbing rear wall portion 22.8, and the rear flange of pin 44.8 confronts the hammer 17.8 so as to drive the pin 44.8 inwardly into the chamber 14.8, against the reaction of spring 28.8 so as to thrust the head portion 43.8 against a cap 16.8 that will be in the chamber. Releasing of the hammer and cocking rod will drive the pin 44.8 into the chamber.

In the use and operation of the form illustrated in FIGS. 11-13, a cap 16.8 is placed upon the mounting peg on piston 15.8 and then the piston 15.8 is inserted into the chamber 14.8 until the cap 16.8 bears against the head 43.8. In this circumstance, the wheels of the vehicle 11.8 may be off the surface S as illustrated in FIG. 11. Manual pressure will be applied downwardly on the launcher frame as indicated by arrow D in FIG. 12 so as to lower the housing 18.8 against the closure panel 18.86 to close the open side 18.85 of the housing, whereupon the closure panel 18.86 will engage and bear against the O-rings 19.8 on the piston 15.8. When the launcher has been pushed downwardly, the wheels of the vehicle will simultaneously be lowered into the dotted line position P seen in FIG. 11, and the launcher frame 23.8 will simultaneously be lowered into the dotted line position P seen in FIG. 12. In this condition, the chamber 14.8 is sealed adjacent its rear end and the cocking rod and hammer will be released to drive the pin 44.8 and its head 43.8 against the cap, causing detonation of the cap. As previously described, detonation of the cap will cause burning of the powder in the cap and expansion of the gases in the chamber to propel the vehicle 11.8 forwardly.

The form of the invention illustrated in FIGS. 11-13 provides the advantage of requiring that the launcher and vehicle rest upon a flat surface S before the cap is detonated and the vehicle is allowed to move forwardly. Accordingly, the assembled launcher and vehicle may not be simply carried around and cause the vehicle to be propelled like a missile through the air. It must rest upon a surface or floor. This arrangement provides a substantial safety measure in the use and operation of the toy.

Figure 14:
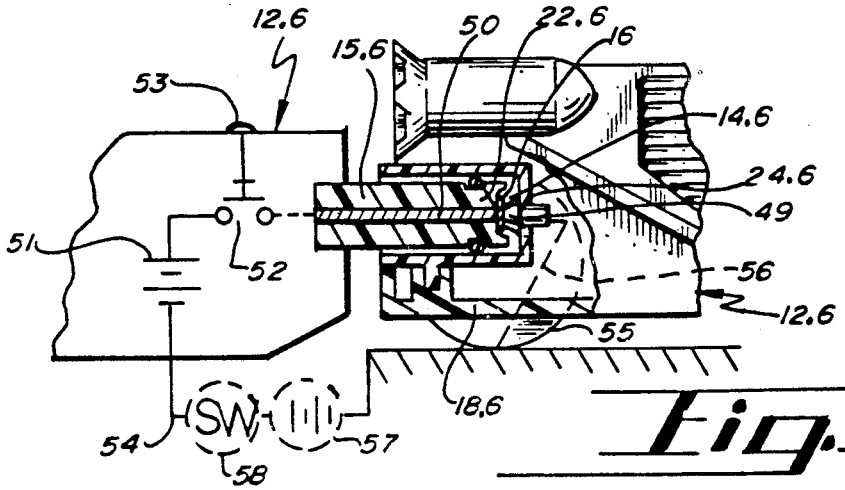
FIG. 14 is a diagrammatic view illustrating an alternate form of detonating the cap.
Figure 15:
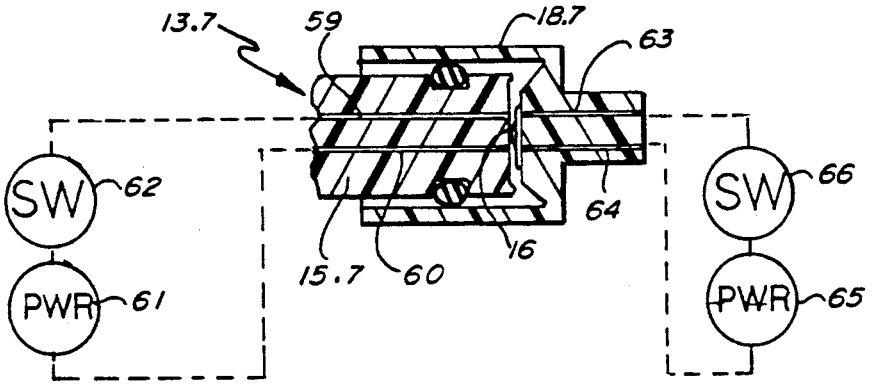
FIG. 15 is still another alternate form of detonating the cap.

FIGS. 14 and 15 are diagrammatic views illustrating two separate ways of detonating a cap in the toy in addition to detonating the caps by impact as illustrated in FIGS. 1-10. In FIG. 14, a cap 16 is confined in the detonating chamber and will be detonated by an electric spark or current through the cap and supplied from contacts 49, 50, respectively mounted on the bottom wall or thrust absorbing portion 24.6 of housing portion 18.6 and in the recoil absorbing portion 22.6 of piston portion 15.6 which is assembled in to the chamber 14.6. The contacts are supplied with electric current from a battery 51 which may be in the launcher 12.6 and controlled by a switch 52 operated by a push button 53. The battery is connected through the switch to the conductor contact 50 and is also connected through a conductor 54 which may form a portion of the surface on which the vehicle 12.6 rests, and the vehicle will have a conductive wiper or conductive wheel 55 to provide electrical connection through a conductor 56 to the contact 49. In certain instances a conductor 54 may also have the alternate form of battery 57 therein, together with a control switch 58. If the battery 52 and switch 52 are in the launcher 12.6, the detonating the cap may be controlled from the launcher. In other instances it may be desirable to remotely control the detonation whereupon the switch 58 may be used at a remote location for detonating the cap. In some instances it may be desirable to have a multiplicity of starter stations for starting a number of vehicles or race cars and simultaneous to starting may be controlled electrically by a switch such as 58 connected to a multiple contacts in the vehicles and several launchers divided.

In the form illustrated in FIG. 15, the partible connector portion 13.7 may have a piston portion 15.7 on the launcher and a housing portion 18.7 on the vehicle or vice versa. A pair of contacts 59 and 60 on the piston portion 15.7 may be connected through conductors to a source of power 61 and a control switch 62 for supplying current and spark to the cap 16 which will lie against both of the contacts 59, 60. Alternatively, contacts 63, 64 may be provided on a portion of the housing 18.7 so that electric power may be supplied from a battery 65 and a control switch 66 connecting by a conductor through the vehicle so as to designate the cap 16 from an external source of power 65. Again, multiple forces of power and contact may be used at various stations to simultaneously detonate caps and provide a racing situation for multiplicity of vehicles.

It will be seen that the powered toy vehicle will be propelled from detonation of a cap of the type used in toy cap guns in a chamber of a partible connection wherein a housing portion receives a piston portion and provision is made for detonating the cap in the chamber.

I claim:

1. A powered toy utilizing explosive caps of the type used in toy pistols, comprising a toy vehicle comprising a thrust absorbing portion propelling the vehicle upon application of thrust thereto, and a launcher comprising a recoil absorbing portion demountably assemblable with said thrust absorbing portion, said thrust absorbing and recoil absorbing portions comprising facing portions confronting each other with such a cap therebetween and said facing portions respectively comprise an open-ended housing portion and a piston portion removably received in the housing portion, the housing portion comprising an openable and closable side portion through which detonating gases are diverted unless the side portion is closed during detonation.

2. A powered toy utilizing explosive caps of the type used in toy pistols, comprising a vehicle capable of travel, a launcher for the vehicle, and a partible connector means comprising a first portion on the launcher and a second portion on the vehicle, the connector means carrying such a cap between the first and second portions to produce travel inducing thrust onto the vehicle when the cap is detonated, said first portion comprising an elongate chamber portion including an endwall and a sidewall receiving the second portion therein, the entire chamber portion being movable relative to the launcher and in a direction opposite to said travel inducing thrust resulting in separation of the vehicle from the launcher.

3. A powered toy according to claim 2 wherein said launcher comprises a spring bearing against the chamber portion and resisting movement thereof.

4. A powered toy utilizing explosive caps of the type used in toy pistols, comprising a vehicle capable of travel, a launcher for the vehicle, and a partible connector means comprising a first portion on the launcher and a second portion on the vehicle, the connector means carrying such a cap between the first and second portions to produce travel inducing thrust onto the vehicle when the cap is detonated, said first portion comprising an elongate chamber portion receiving the second portion therein, the chamber portion being movable relative to the launcher and in a direction opposite to said travel inducing thrust, said launcher comprising a spring bearing against the chamber portion and resisting movement thereof, the spring urging the chamber portion in said direction opposite to said thrust.

5. A powered toy utilizing explosive caps of the type used on toy pistols, comprising a vehicle capable of travel, a launcher for the vehicle, a partible connector means comprising a first portion on the launcher and a second portion on the vehicle, the connector means carrying such a cap between the first and second portions to produce travel inducing thrust onto the vehicle when the cap is detonated, said first and second portions confining a cap therebetween to be detonated for applying travel inducing thrust to the vehicle, said first and second portions having cooperative pressure applying means for detonating the cap, said first portion being movable with respect to the launcher in a first direction toward the second portion to impact the cap against the second portion to detonate the cap and propel the vehicle and also movable in a second direction away from said second portion in response to detonation of the cap, and spring means biasing the first portion in said second direction.

6. A powered toy according to claim 5 and the launcher also having recoil absorbing stop means adjacent the movable first portion to limit movement of the first portion under influence of the detonating cap.

7. A powered toy according to claim 5 wherein the first portion is a ram and the second portion is a ram housing slidably receiving the ram and defining said chamber.

8. A powered toy according to claim 5 wherein the second portion is a ram and the first portion is a ram housing slidably receiving the ram and defining said chamber.

9. A powered toy according to claim 5 wherein said pressure applying means comprises a pin means to bear against and apply localized intense pressure onto the cap to cause detonation thereof.

10. A powered toy according to claim 5 wherein the launcher comprises a spring pressed driver producing sudden movement of said first portion against the cap to produce detonation thereof.

11. A powered toy according to claim 10 wherein said launcher comprises a releasable latch restraining operation of the driver.

12. A powered toy according to claim 10 wherein the driver comprises a rod portion with a driving head to bear against and drive said first portion against the cap.

13. A powered toy according to claim 10 wherein said driver comprises a swinging arm portion to bear against and drive said first portion against the cap.

14. A powered toy utilizing explosive caps of the general type used in toy pistols, comprising a vehicle part capable of travel, a launcher part for the vehicle, and an open ended cap confining chamber portion on one of said parts and a piston portion on the other of said parts and assembled into the chamber, the piston portion comprising a front end with a cap carrying means restricting displacement of the cap relative to the piston portion, the chamber and piston portion being driven apart by the detonation of the cap to propel the vehicle part away from the launcher part.

15. A powered toy according to claim 14 wherein the piston portion is on the vehicle part.

16. A powered toy utilizing cup-shaped caps according to claim 14 wherein the cap carrying means comprises a peg on the front end of the piston portion to receive and carrying such a cup-shaped cap.

17. A powered toy according to claim 14 wherein the chamber portion is on the launcher part and being movable toward the piston part, and a hammer on the launcher to suddenly impact the chamber portion and deliver an impact to the cap within the chamber for detonating the cap.

18. A powered toy according to claim 14 wherein the cap carrying means comprises a recess in the front end of the piston portion to receive and carry a cap into the chamber portion.

19. A powered toy according to claim 14 wherein a pair of contacts provide electric current to the cap within the chamber for detonating the cap.

20. A powered toy according to claim 14 wherein the chamber comprises a housing portion, the housing portion comprising an openable and closable exhaust port diverting a portion of the detonating gases of the cap to minimize propulsion of the vehicle.

* * * * *

UNITED STATES PATENT AND TRADEMARK OFFICE

CERTIFICATE OF CORRECTION

PATENT NO. : 5,141,467

DATED : August 25, 1992

INVENTOR(S) : Scott C. Crosbie

It is certified that error appears in the above-identified patent and that said Letters Patent is hereby corrected as shown below:

Column 4, line 64, delete "!2" and insert --12--.

Column 5, line 14, delete "!5" and insert --15--.

Signed and Sealed this

Twelfth Day of October, 1993

*Attest:*

*Attesting Officer*

BRUCE LEHMAN

*Commissioner of Patents and Trademarks*